US007369143B2

(12) United States Patent
Koyama

(10) Patent No.: US 7,369,143 B2
(45) Date of Patent: May 6, 2008

(54) DISPLAY DEVICE

(75) Inventor: Jun Koyama, Sagamihara (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 507 days.

(21) Appl. No.: 10/687,742

(22) Filed: Oct. 20, 2003

(65) Prior Publication Data

US 2004/0080501 A1 Apr. 29, 2004

(30) Foreign Application Priority Data

Oct. 21, 2002 (JP) ..... 2002-305673

(51) Int. Cl.
*G09G 5/10* (2006.01)

(52) U.S. Cl. ..... 345/691

(58) Field of Classification Search ..... 345/691, 345/211–214, 76–100, 204, 205, 103; 359/630; 315/169.3; 323/282; 363/59; 349/155, 349/158; 427/66; 250/370.09–370.11
See application file for complete search history.

(56) References Cited

U.S. PATENT DOCUMENTS 5,343,217 A 8/1994 Kim
5,349,366 A 9/1994 Yamazaki et al.
5,583,424 A * 12/1996 Sato et al. ..... 323/282
5,859,626 A 1/1999 Kawamura
6,184,968 B1 * 2/2001 Taylor-Smith ..... 349/158
6,339,422 B1 1/2002 Kuwajima et al.
6,522,319 B1 * 2/2003 Yamazaki ..... 345/103
6,577,072 B2 6/2003 Saito et al.
6,633,287 B1 * 10/2003 Yatabe et al. ..... 345/211
6,693,412 B2 * 2/2004 Ruan et al. ..... 323/282
6,909,413 B2 6/2005 Nanno et al.
7,042,162 B2 * 5/2006 Yamazaki et al. ..... 315/169.3
7,067,170 B2 * 6/2006 Marcus et al. ..... 427/66
7,129,939 B2 * 10/2006 Toyozawa et al. ..... 345/211
7,148,886 B2 * 12/2006 Nakajima ..... 345/211
7,205,989 B2 4/2007 Nakajima
2001/0007432 A1 * 7/2001 Ayres ..... 327/536
2001/0013853 A1 * 8/2001 Suzuki ..... 345/92
2002/0008834 A1 * 1/2002 Suzuki ..... 349/155

(Continued)

FOREIGN PATENT DOCUMENTS

CN 1308407 8/2001

(Continued)

OTHER PUBLICATIONS

Office Action (Application No. 200310102888.1) Dated May 18, 2007.

*Primary Examiner*—Prabodh Dharia
(74) *Attorney, Agent, or Firm*—Eric J. Robinson; Robinson Intellectual Property Law Offic, P.C.

(57) ABSTRACT

A display device according to the present invention includes a switching regulator control circuit formed of TFTs. A digital switching regulator control circuit is composed of an AD converter circuit, a CPU, a pulse generation circuit or the like. An analog switching regulator control circuit is composed of an error amplifier circuit, a triangle wave generation circuit, a PWM comparator or the like. By integrally forming the switching regulator control circuit on a display device, the problem of the conventional portable information equipment as to the reduction in size and weight can be solved.

34 Claims, 12 Drawing Sheets

U.S. PATENT DOCUMENTS

| | | | | |
|---|---|---|---|---|
| 2002/0036636 | A1* | 3/2002 | Yanagi et al. | 345/211 |
| 2002/0044145 | A1* | 4/2002 | Tomio et al. | 345/211 |
| 2002/0135574 | A1* | 9/2002 | Nakamura | 345/204 |
| 2002/0145041 | A1* | 10/2002 | Muthu et al. | 235/454 |
| 2002/0145602 | A1* | 10/2002 | Matsueda | 345/213 |
| 2002/0154151 | A1 | 10/2002 | Koyama | |
| 2002/0158590 | A1* | 10/2002 | Saito et al. | 315/291 |
| 2002/0175662 | A1* | 11/2002 | Sakurai et al. | 323/312 |
| 2002/0175887 | A1* | 11/2002 | Yamazaki | 345/87 |
| 2002/0180721 | A1 | 12/2002 | Kimura et al. | |
| 2003/0011586 | A1* | 1/2003 | Nakajima | 345/211 |
| 2003/0053321 | A1* | 3/2003 | Ishiyama | 363/59 |
| 2003/0058543 | A1* | 3/2003 | Sheedy et al. | 359/630 |
| 2003/0063077 | A1 | 4/2003 | Koyama | |
| 2003/0067434 | A1 | 4/2003 | Haga et al. | |
| 2003/0174153 | A1 | 9/2003 | Koyama | |
| 2003/0201967 | A1* | 10/2003 | Yu | 345/102 |
| 2004/0080500 | A1 | 4/2004 | Koyama | |
| 2005/0041002 | A1* | 2/2005 | Takahara et al. | 345/76 |
| 2005/0052447 | A1* | 3/2005 | Ishiyama | 345/211 |
| 2005/0184943 | A1 | 8/2005 | Nakajima | |
| 2006/0054834 | A1* | 3/2006 | Kameshima | 250/370.11 |
| 2006/0187172 | A1 | 8/2006 | Nakajima | |
| 2007/0069144 | A1* | 3/2007 | Kameshima | 250/370.09 |

FOREIGN PATENT DOCUMENTS

| | | |
|---|---|---|
| EP | 1 304 791 | 4/2003 |
| JP | 11-202290 | 7/1999 |
| JP | 2002-175027 | 6/2002 |
| JP | 2002-175049 | 6/2002 |
| WO | WO 01/45470 | 6/2001 |
| WO | WO 02/47243 | 6/2002 |

* cited by examiner

DISPLAY DEVICE

BACKGROUND OF THE INVENTION

Field of the Invention

The present invention relates to a display device having a power supply circuit, and more particularly such a display device in which a switching regulator control circuit is made up of a thin film transistor.

In recent years, with the advance of the communication technology, cellular phones have been widely used. In future, transmission of moving images and transmission of a large volume of information are expected. On the other hand, through reduction in weight of personal computers, those adapted for mobile communication have been produced. Information terminals called PDA originated in electronic notebooks have also been produced in large quantities and widely used. In addition, with the development of display devices, most of those portable information devices are equipped with a flat panel display.

The conventional film forming of a polycrystalline semiconductor has been performed at high temperature of 1000° C. or higher. However, in recent years, film forming is performed at low temperature of at most 500° C. By the use of polycrystalline semiconductor TFTs (thin film transistors) formed by a low-temperature film forming process, manufacturing of an active matrix display device is promoted. Such an active matrix display device has advantages in that in addition to manufacturing a pixel, a signal line drive circuit can be integrally formed around a pixel portion.

Thus, it is possible to realize compactness and high definition of a display device, and the display device is expected to be more widely used in future. The conventional display device made up of polycrystalline semiconductor TFTs which are formed by a low-temperature film forming process incorporated a circuit for writing a picture signal to a pixel, but a power supply circuit was not incorporated in the device and it was externally attached.

In the portable devices such as portable information equipment, a lithium-ion battery is generally used as power supply. The lithium-ion battery outputs a DC voltage of 3.6 V or so and is widely used for the advantages of long lifetime, high-speed charge, satisfactory retention characteristic, and high safety. However, for driving a material such as liquid crystal or organic EL (electroluminescence) used for display devices, the voltage of 3.6 V is not sufficient, and the voltage from 10 to 18 V is required.

Therefore, as shown in FIG. 2, a switching regulator has been conventionally formed on a printed circuit board to supply a voltage necessary for driving. FIG. 2 is an outline drawing which shows the peripheral area of a display device of the conventional portable information equipment with a switching regulator. On a substrate 213, integrally formed are a pixel portion 204, a source signal line drive circuit 202, and a gate signal line drive circuit 203, and attached to the substrate are an FPC (Flexible Printed Circuit) 205 and an opposing substrate 212. On a printed circuit board 206, packed is the switching regulator comprising a switching regulator control circuit 207, an inductor 208, a switching element 209, a diode 210, and a smoothing capacitor 211.

The switching regulator technique is described in detail in a non-patent document 1.

[Non-Patent Document 1]

Morio Sato, "Switching Electric Power Design manual", published by Nikkan Kogyo Shinbun, Nov. 25, 1998

As described above, in the conventional display device made up of polycrystalline semiconductor TFTs formed by a low-temperature film forming process, a circuit for writing a picture signal to a pixel portion was incorporated, but a power supply circuit was externally attached. For this reason, the augmentation of the set size was caused due to increases in externally attached parts and in the occupied area.

SUMMARY OF THE INVENTION

To solve the above problems, the present inventors have considered that, by the use of polycrystalline semiconductor TFTs which are formed by a low-temperature film forming process, a switching regulator control circuit can be incorporated in the display device. Since a polycrystalline semiconductor conducts electricity more easily than an amorphous semiconductor, the polycrystalline semiconductor TFT has higher driving performance as compared with the amorphous semiconductor TFT. Accordingly, a switching regulator control circuit can be made up of polycrystalline semiconductor TFTs.

In the above-described display device, at least TFTs which constitute a switching regulator control circuit are integrally formed with a display portion on the same substrate to simplify the manufacturing process of the device. As a result, it is possible to narrow the frame, reduce thickness, and realize compactness of the display device, therefore, the advantages of expanding the possibility of display design are obtained.

The structure of the present invention will be described below.

A display device according to the present invention comprises a switching regulator control circuit made up of a thin film transistor on a substrate.

A display device according to the present invention comprises a switching regulator control circuit made up of a thin film transistor on a substrate, and the display device is characterized in that a switching element is driven according to an output signal from the switching regulator control circuit to raise or lower the voltage.

A display device according to the present invention comprises a thin film transistor on a substrate, a switching regulator control circuit, a switching element, an inductor, a diode, and a smoothing capacitor, and the display device is characterized in that the switching regulator control circuit comprises a voltage feed back circuit which feeds back the voltage of the smoothing capacitor, and a duty control circuit which controls a switching duty of the switching element.

The display device of the present invention described above is characterized in that the inductor, the diode, and the smoothing capacitor are packed on an FPC.

The display device of the present invention described above is characterized in that the inductor, the diode, and the smoothing capacitor are packed on a TFT substrate.

The display device of the present invention described above is characterized in that the switching element is made up of a thin film transistor.

A display device according to the present invention comprises a thin film transistor on a substrate and a switching regulator control circuit using an analog signal.

The display device of the present invention described above is characterized in that the switching regulator control circuit comprises a reference voltage source, an error amplifier circuit, a triangle wave generation circuit, and a PWM (pulse width modulation) comparator.

A display device according to the present invention comprises a thin film transistor on a substrate and a switching regulator control circuit using a digital signal.

The display device of the present invention described above is characterized in that the switching regulator control circuit comprises an AD (analog/digital) converter circuit, a nonvolatile memory, a CPU (central processing unit), and a pulse generation circuit.

The display device of the present invention described above is characterized in that a plurality of switching regulator control circuits are formed on the substrate.

The display device of the present invention described above is a liquid crystal display device.

The display device of the present invention described above is an EL display device.

A display device according to the present invention is electronic equipment using the above-described display device.

Then, incorporating a switching regulator control circuit into a display device is achieved to realize reduction in size and weight of electronic equipment.

DESCRIPTION OF THE PREFERRED EMBODIMENTS

Embodiment modes of the present invention will be hereinafter described with reference to figures.

Figure 1:
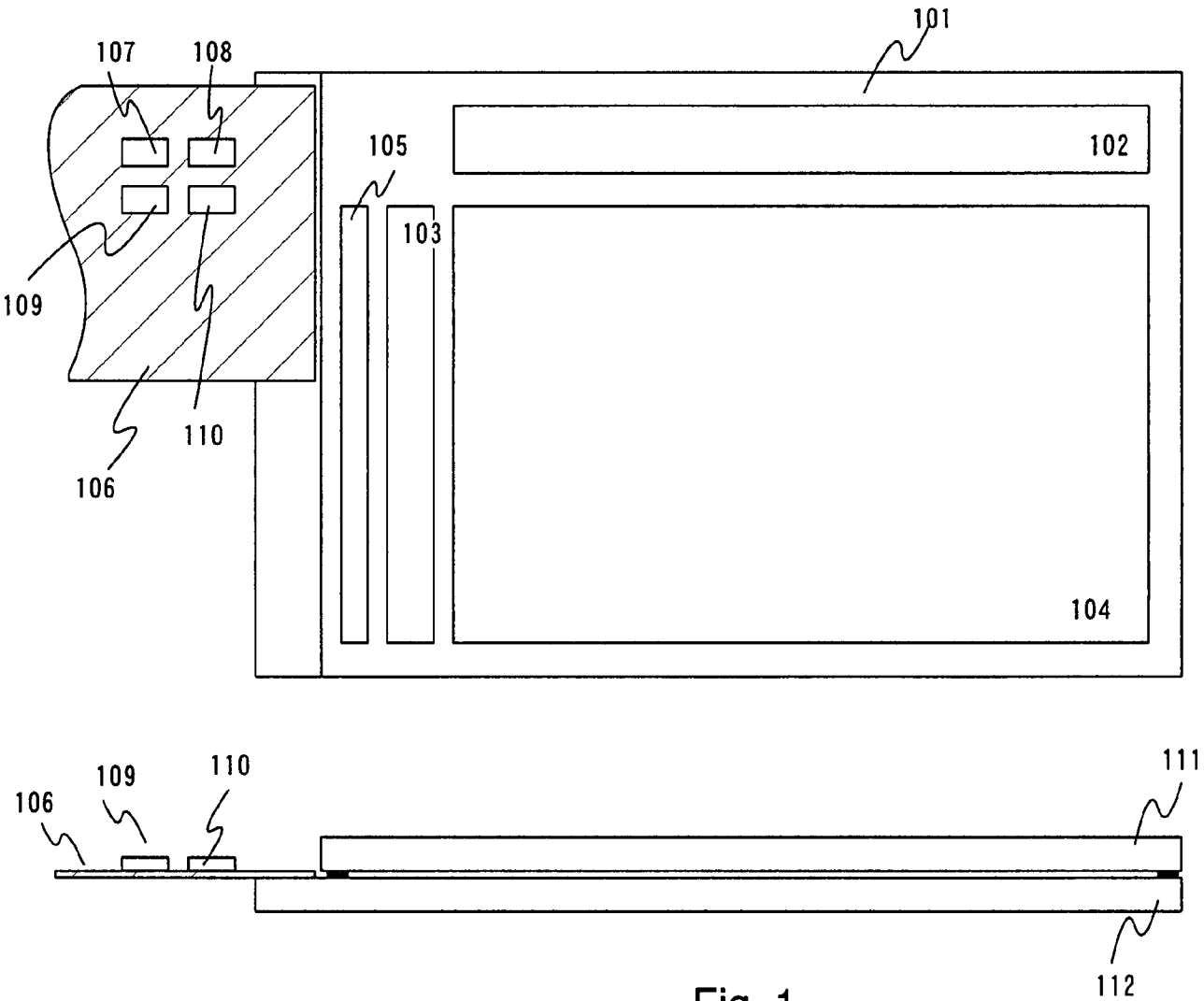
FIG. 1 is an outline drawing of a display device of the present invention.
Figure 2:
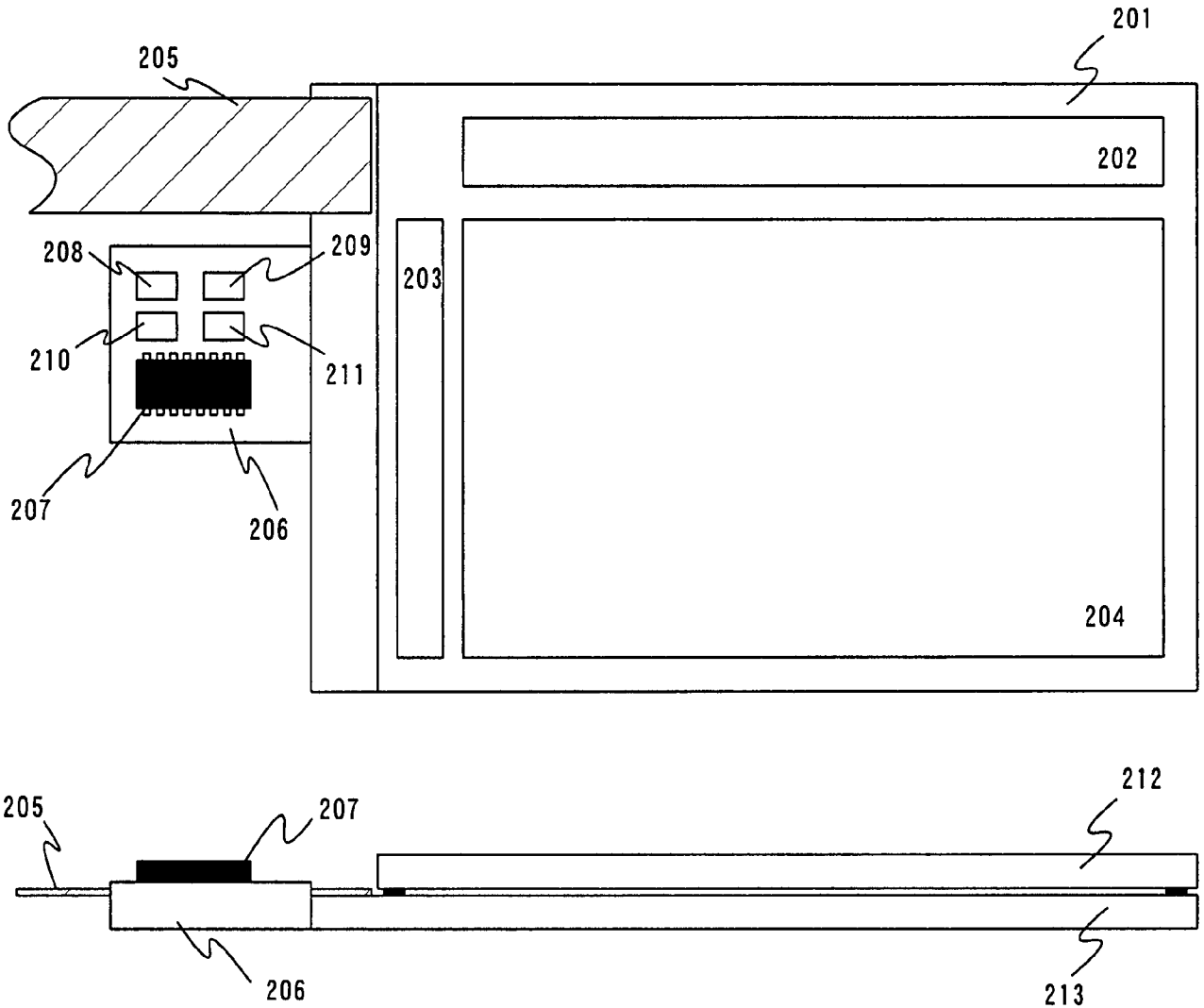
FIG. 2 is an outline drawing of a conventional display device.

FIG. 1 is an outline drawing of a display device according to the present invention. On a substrate 112 of a display device 101 of the invention, integrally formed are a pixel portion 104, a source signal line drive circuit 102, a gate signal line drive circuit 103, and a switching regulator control circuit 105 by the use of TFTs, and constituted is an opposing substrate 111 thereon. On an FPC 106, formed are an inductor 107, a switching element 108, a diode 109, and a smoothing capacitor 110. These elements on the FPC can be also packed on the substrate 112, the substrate 111, or another substrate in place of on the FPC. The switching element can be made up of TFTs when there is an only small current flowing in it. The substrate used here is formed from glass, plastic, stainless, silicon, and the like.

In this manner, by integrally forming a switching regulator control circuit on the display device, the problem of the conventional portable information equipment as to the reduction in size and weight can be solved.

Figure 3:
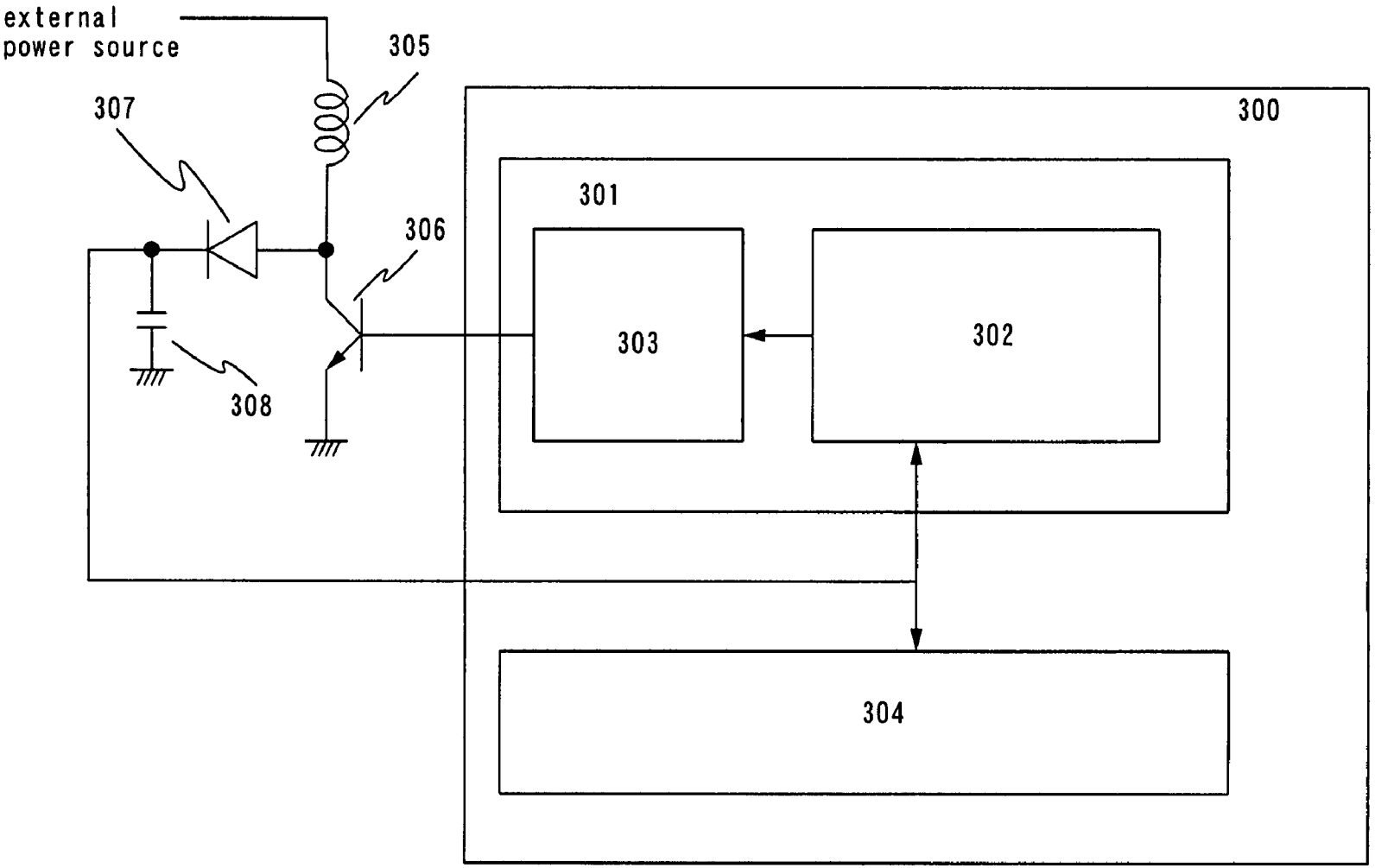
FIG. 3 is a block diagram of a switching regulator control circuit of the invention.

FIG. 3 is a block diagram of the switching regulator control circuit using for the present invention. In this figure, a switching regulator control circuit 301 and a driver circuit 304 of the invention are formed on a substrate 300. Similarly, it is possible to form on the same substrate a pixel portion and an image processing circuit which are not shown in FIG. 3.

The switching regulator control circuit 301 is composed of two blocks: a voltage feed back circuit 302 and a duty control circuit 303. The voltage feed back circuit 302 inputs a voltage output from the switching regulator, and outputs a signal according to the voltage into the duty control circuit 303. The duty control circuit 303 outputs a pulse which converted the duty corresponding to the signal of the voltage feed back circuit. A switching element 306 performs the switching according to the pulse output from the duty control circuit 303. In FIG. 3, the switching element 306 marks an NPN bipolar transistor formed of TFTs, but can be made using a MOS transistor formed of TFTs. Furthermore, it is possible to change the polarity. The longer the switching element is on, the more energy is stored in an inductor 305. When the switching element 306 is off, a high charging efficiency is obtained in a smoothing capacitor 308 through a diode 307.

When a voltage output from the switching regulator (voltage in the smoothing capacitor 308) is lowered, a voltage input to the voltage feed back circuit 302 is lowered. At the same time, the voltage feed back circuit 302 outputs a signal into the duty control circuit 303 to increase the duty. The duty control circuit 303 inputs the signal into the switching element 306 to drive the element with a higher duty. Accordingly, the higher energy is stored in the inductor 305 which operates so as to increase the voltage in the smoothing capacitor.

On the other hand, when a voltage output from the switching regulator (voltage in the smoothing capacitor 308) is increased, a voltage input to the voltage feed back circuit 302 is increased. At the same time, the voltage feed back circuit 302 outputs a signal into the duty control circuit 303 to lower the duty. The duty control circuit 303 inputs the signal into the switching element 306 to drive the element with a lower duty.

Accordingly, the lower energy is stored in the inductor 305 which operates so as to lower the voltage in the smoothing capacitor.

In this manner, the voltage output from the switching regulator is kept constant. An external power supply voltage supplied by a lithium-ion battery of 3.6 V, for example, can be raised to 16 V according to the present invention to be used as a power supply voltage of the driver circuit 304.

The voltage feed back circuit and the duty control circuit can be realized by either of the analog signal process or digital signal process. Explanation will be made on these processes with reference to the embodiments below.

Embodiment 1

Figure 4:
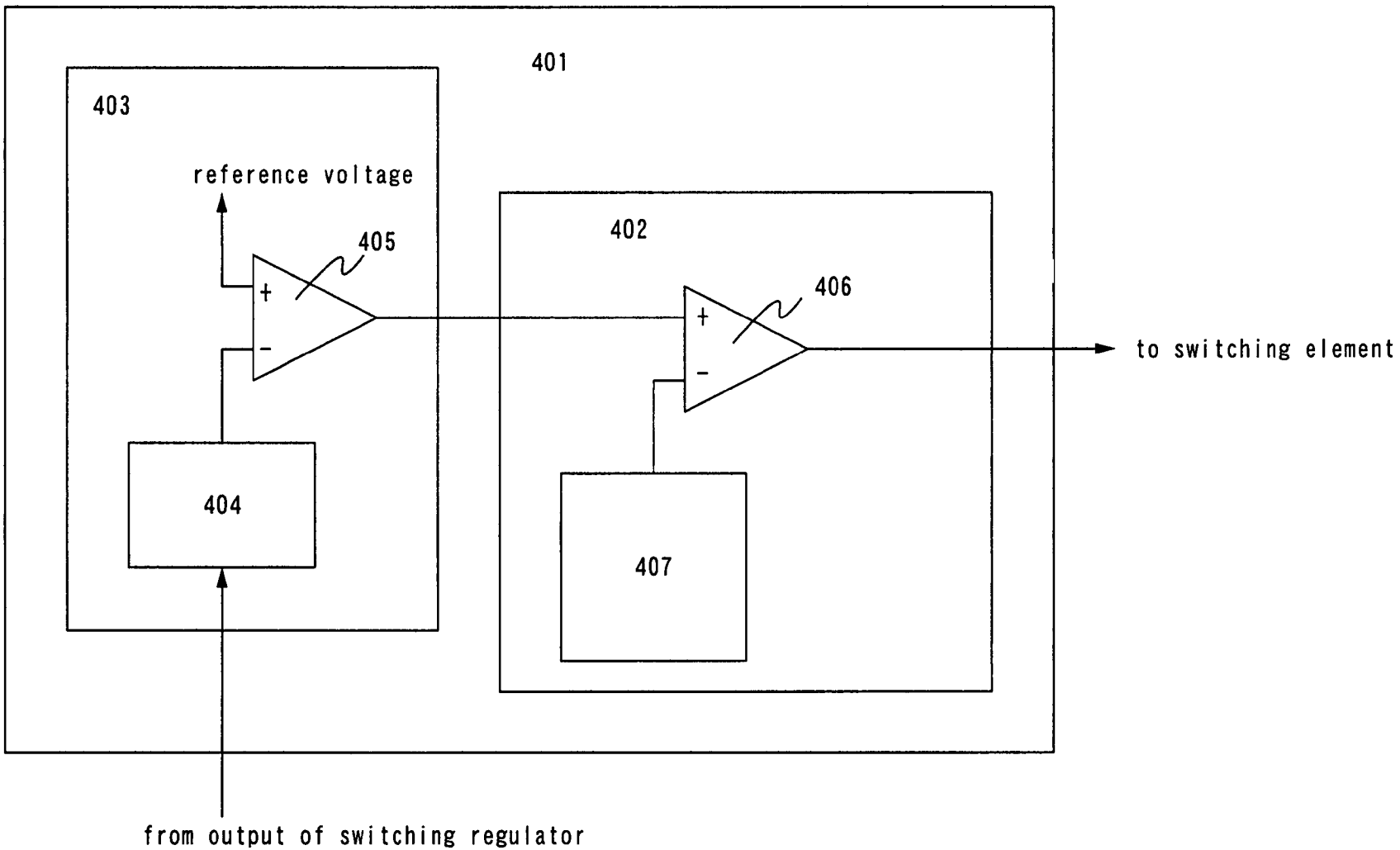
FIG. 4 is a diagram of an analog switching regulator control circuit of the invention.

FIG. 4 is a block diagram of an analog switching regulator control circuit. A switching regulator control circuit 401 is composed of a voltage feed back circuit 403 and a duty control circuit 402. The voltage feed back circuit 403 is formed of an attenuator 404 and an error amplifier circuit 405, and the duty control circuit 402 is formed of a triangle wave generation circuit 407 and a PWM comparator 406. The voltage output from the switching regulator is divided by the attenuator 404 and input to an input portion of the error amplifier circuit, in which the other input portion is connected to a reference voltage. Then, the divided voltage is compared with the reference voltage to increase the difference. Incidentally, the attenuator 404 is not indispensable. The PWM comparator 406 compares the voltage output from the error amplifier circuit 405 with that of the triangle wave generation circuit to output a pulse with a high duty ratio when the voltage output from the error amplifier circuit 405 is higher. Therefore, as described above, the amount of energy stored in the inductor is increased, as well as the voltage output from the switching regulator. As a result, the voltage output from the attenuator 404 is increased and approximates to the reference voltage. When the voltage output from the error amplifier circuit is lower as compared to that of the triangle wave generation circuit, the reverse operation to the above is performed and the voltage output from the attenuator 404 approximates to the reference voltage. When the attenuator ratio is 4:1, for instance, the voltage output from the switching regulator is four times as high as the reference voltage, but this ratio can be determined by a practitioner. In this manner, operated is the analog switching regulator control circuit of the present invention.

Embodiment 2

Figure 5:
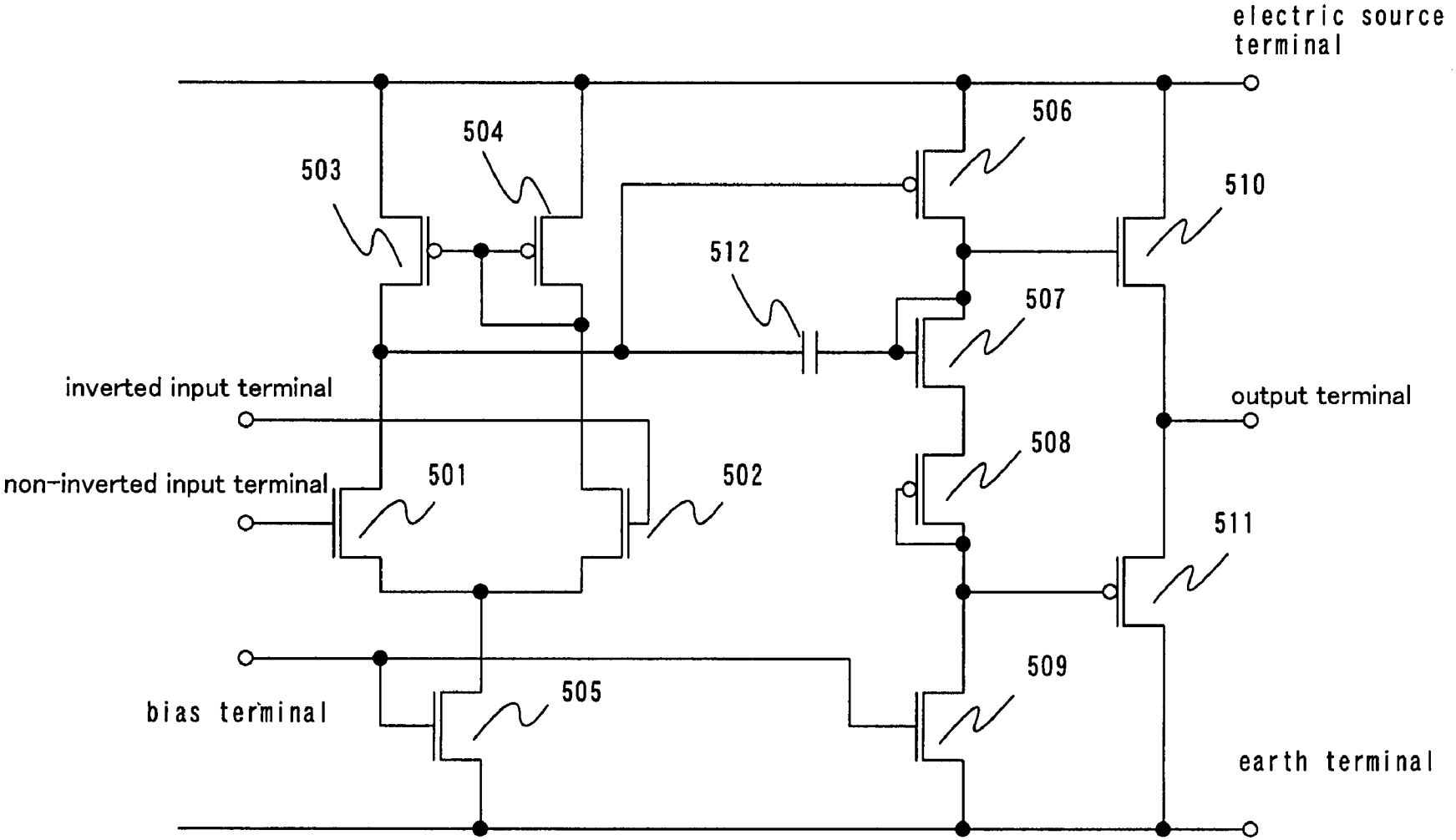
FIG. 5 is an equivalent circuit diagram of an operational amplifier circuit of the invention.

In the above-described analog switching regulator control circuit, an error amplifier circuit and a PWM comparator are often formed with an operational amplifier circuit. FIG. 5 is an equivalent circuit diagram which shows an operational amplifier circuit made up of TFTs. The operational amplifier circuit comprises a differential circuit formed of TFTs 501 and 502, a current mirror circuit formed of TFTs 503 and 504, a constant current source formed of TFTs 505 and 509, a common source circuit formed of a TFT 506, an idling circuit formed of TFTs 507 and 508, a source follower circuit formed of TFTs 510 and 511, and a phase compensation capacitor 512.

Explanation is hereinafter made on the operation of the operational amplifier circuit shown in FIG. 5. When a plus signal (+) is input to a non-inverted input terminal, the drain current of the TFT 501 is higher than that of the TFT 502 because the sources of TFTs forming the differential circuit are connected to the constant current source formed of the TFT 505. Since the current mirror circuit is formed of the TFTs 504 and 503, the drain current of the TFT 503 is as much as that of the TFT 502. The difference in the drain current between the TFT 503 and the TFT 501 makes the gate potential of the TFT 506 lowered. Since the TFT 506 is a P-type TFT, when the gate potential of the TFT 506 is lowered, the TFT 506 is turned ON to increase the drain current. Accordingly, the gate potential of the TFT 510 is raised, and the source potential of the TFT 510, i.e., the output terminal is thus raised.

When a minus signal (−) is input to a non-inverted input terminal, the drain current of the TFT 501 is smaller than that of the TFT 502. Since the drain current of the TFT 503 is as much as that of the TFT 502, the difference in the drain current between the TFT 1503 and the TFT 501 makes the gate potential of the TFT 506 raised. As TFT 506 is a P-type TFT, when the gate potential of the TFT 506 is raised, the TFT 506 is turned OFF to decrease the drain current. Accordingly, the gate potential of the TFT 510 is lowered, and the source potential of the TFT 510, i.e., the output terminal is thus lowered. In this manner, the same phase signal as input to the non-inverted input terminal is output from the output terminal.

When a plus signal (+) is input to an inverted input terminal, the drain current of the TFT 501 is smaller than that of the TFT 502. Since the drain current of the TFT 503 is as much as that of the TFT 502, the difference in the drain current between the TFT 503 and the TFT 501 makes the gate potential of the TFT 506 raised. As the TFT 506 is a P-type TFT, it is turned OFF to decrease the drain current when the gate potential of the TFT 506 is raised. Accordingly, the gate potential of the TFT 510 is lowered, and the source potential of the TFT 510, i.e., the output terminal is thus lowered.

When a minus signal (−) is input to an inverted input terminal, the drain current of the TFT 501 is higher than that of the TFT 502. Since the drain current of the TFT 503 is as much as that of the TFT 502, the difference in the drain current between the TFT 503 and the TFT 501 makes the gate potential of the TFT 506 lowered. As the TFT 506 is a P-type TFT, it is turned ON to increase the drain current when the gate potential of the TFT 506 is lowered. Accordingly, the gate potential of the TFT 510 is raised, and the source potential of the TFT 510, i.e., the output terminal is thus raised. In this manner, the opposite phase signal of that input to the inverted input terminal is output from the output terminal.

In this embodiment, the differential circuit and the current mirror circuit are formed of Nch TFTs and Pch TFTs respectively, but the invention is not exclusively applied to this structure and they can be formed of Pch TFTs and Nch TFTs respectively. Furthermore, the invention is not exclusively applied to such a circuit structure, and any circuit that works as an operational amplifier circuit can be utilized.

This embodiment can be implemented in combination with Embodiment 1 described above.

Embodiment 3

Figure 6:
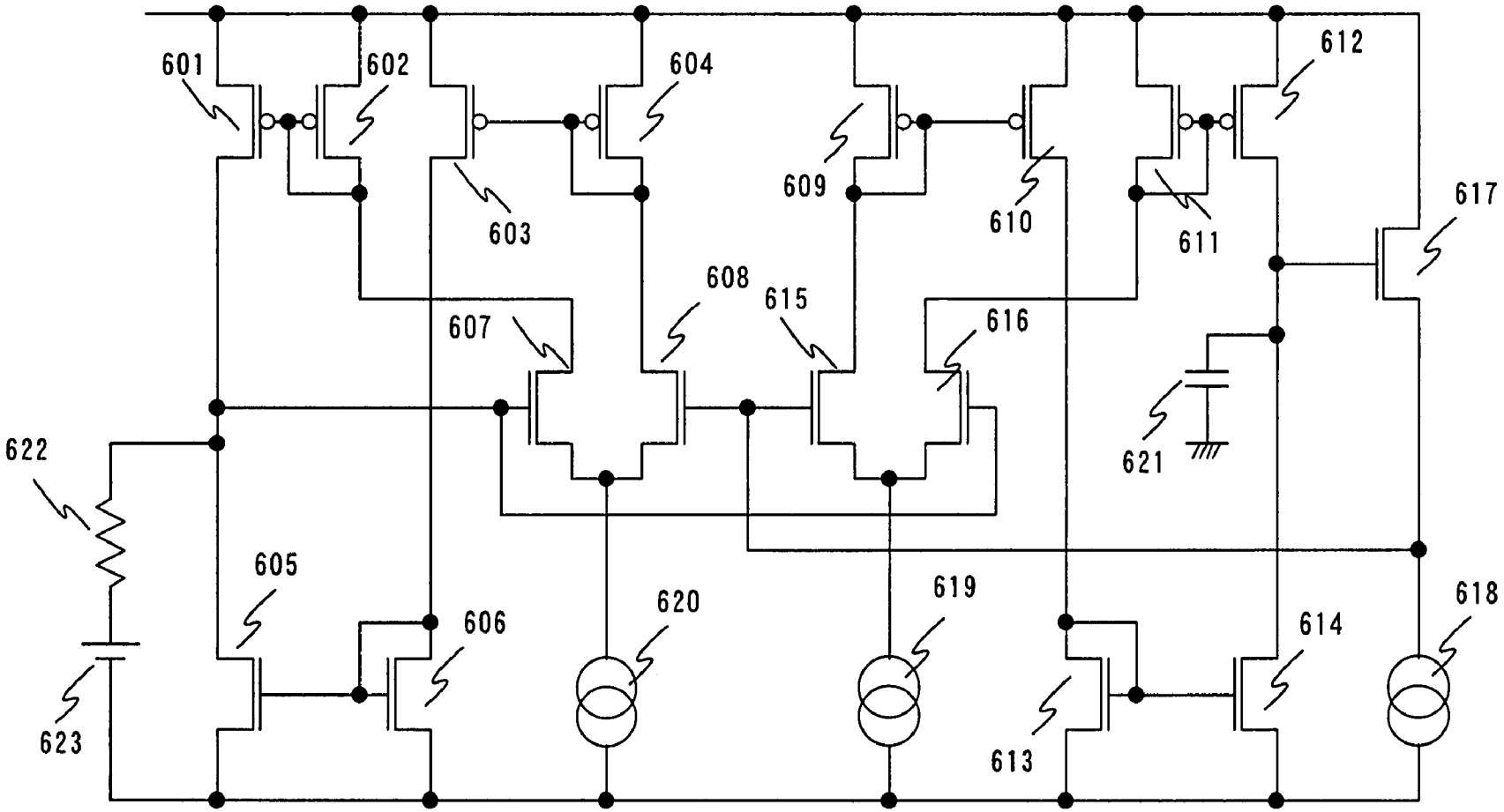
FIG. 6 is an equivalent circuit diagram of a triangle wave generation circuit of the invention.

With reference to FIG. 6, explanation will be made on the operation of a triangle generation circuit. In a differential circuit formed of TFTs 607 and 608, a current is provided in either of the two TFTs. For instance, when the gate potential of the TFT 607 is higher than that of the TFT 608, the current from a constant current source 620 flows in the TFTs 607 and 602 as well as in a TFT 601, because the TFTs 601 and 602 form a current mirror circuit. The TFT 608 is OFF in this case, therefore, a current mirror circuit formed of TFTs 604 and 603 and another current mirror circuit formed of TFTs 606 and 605 are OFF. Accordingly, a current is supplied to a resistance 622 from the TFT 601, and the gate potential of the TFT 607 is thus equal to a reference supply voltage 623 added to IR (I: current from the constant current source 620, R: resistance value of the resistance 622).

On the other hand, in a differential circuit formed of TFTs 615 and 616, each gate is connected to the gates of the TFTs 608 and 607 respectively. Then, the TFT 616 is turned ON and the TFT 615 is OFF, and the current from a current source 619 flows through TFTs 611 and 616. Since the TFT 615 is OFF, a current mirror circuit formed of TFTs 609 and 610 and another current mirror circuit formed of TFTs 613 and 614 are OFF. A current equivalent to the current source 619 flows in a TFT 612 to charge a capacitor 621 which is connected to a source follower circuit formed of a TFT 617. Outputs from the source follower circuit are connected to the gate of the TFTs 608 and 615. When the potential of the capacitor 621 is not sufficiently high, the state of the differential circuit is not changed. However, when the capacitor is charged enough to raise the potential and the gate potential of the TFTs 608 and 615 becomes higher than that of the TFTs 607 and 616, then the state ON/OFF is switched.

When the gate potential of the TFT 607 is lowered as compared to that of the TFT 608, a current from the constant current source 620 flows in the TFTs 608 and 604 as well as in the TFT 603, because the TFTs 603 and 604 form a current mirror circuit.

Similarly, since the TFTs 605 and 606 form another current mirror circuit, a current equivalent to the constant current source 620 flows in the TFT 605. The TFT 607 is OFF, therefore, the current mirror circuit formed of the TFTs 602 and 601 is OFF. Accordingly, a current is supplied to the resistance 622 from the TFT 605, the gate potential of the TFT 607 is thus equal to IR (I: current from the constant current source 620, R: resistance value of the resistance 622) subtracted from a reference supply voltage 623.

On the other hand, in the differential circuit formed of the TFTs 615 and 616, each gate is connected to the gates of the TFTs 608 and 607 respectively. Then, the TFT 616 is turned OFF, the TFT 615 is ON, and the current from the current source 619 flows through the TFTs 609 and 615. Since the TFT 616 is OFF, a current mirror circuit formed of the TFTs 611 and 612 is OFF. A current equivalent to the current source 619 flows in the TFT 610 to discharge the capacitor 621 through the current mirror circuit formed of the TFTs 613 and 614. The capacitor is connected to the source follower circuit formed of the TFT 617, and outputs from the source follower circuit are connected to the gate of TFTs 608 and 615. When the potential of the capacitor 621 is sufficiently high, the state of the differential circuit is not changed. However, when the capacitor is discharged enough to lower the potential and the gate potential of the TFTs 608 and 615 becomes lower than that of the TFTs 607 and 616, the state ON/OFF is switched. The foregoing operation is repeated subsequently.

In the circuit according to this embodiment, the amplitude oscillates at a voltage equal to 21R. Since the voltage output from the capacitor 621 and the source follower circuit is charged and discharged with the constant current, the potential is changed linearly in accordance with time to supply triangle waves. This embodiment can be implemented in combination with Embodiments 1 and 2.

Embodiment 4

Figure 7:
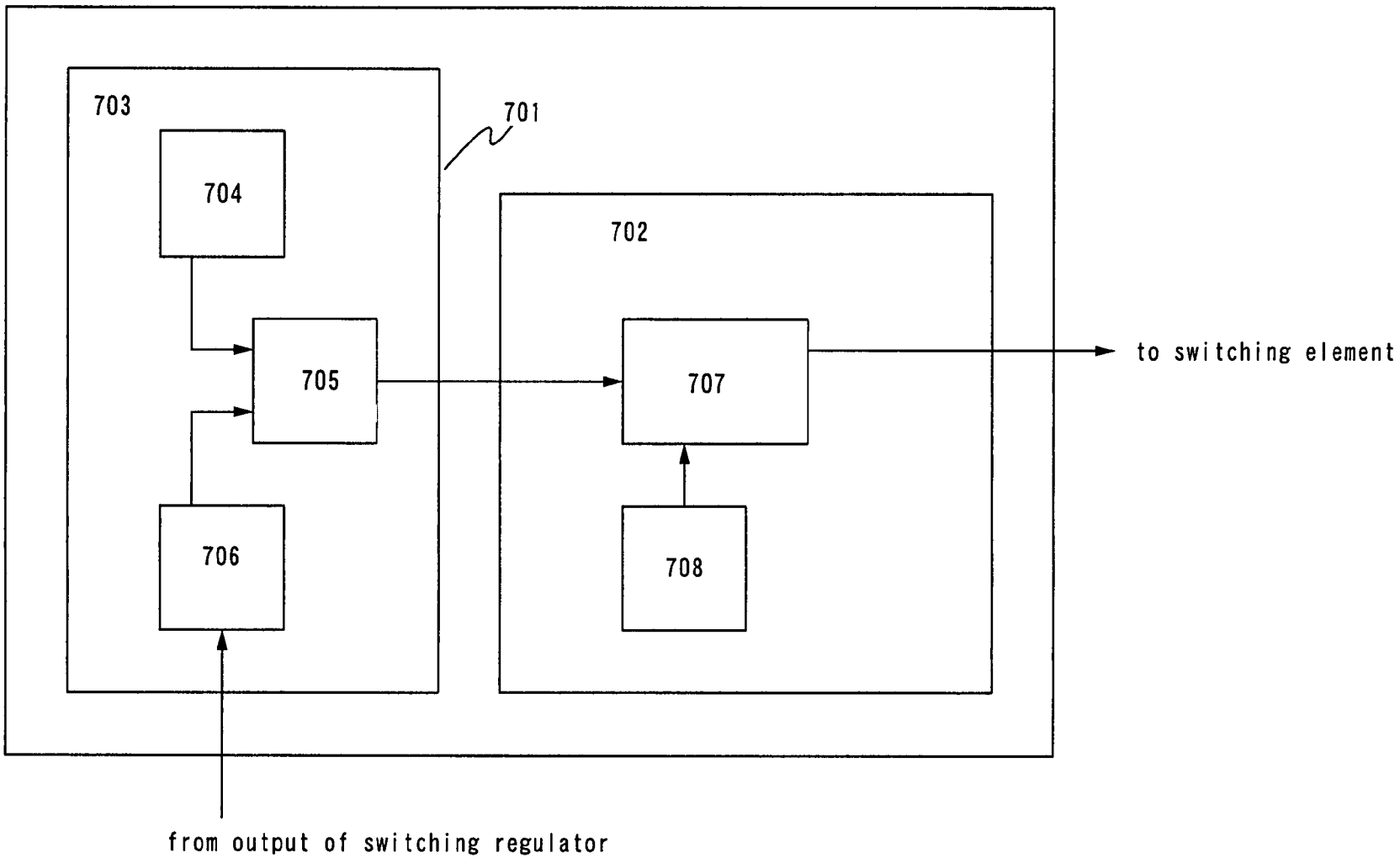
FIG. 7 is a diagram of a digital switching regulator control circuit of the invention.

FIG. 7 shows a digital switching regulator control circuit 701. A voltage feed back circuit 703 is composed of an AD converter circuit 706, a CPU 705, and a nonvolatile memory 704 which stores the data corresponding to the necessary voltage value of a switching regulator. Firstly, the voltage output from the switching regulator is converted from analog to digital in the AD converter circuit 706. Then, the CPU 705 makes reference to the data, which corresponds to the required voltage and is stored in the nonvolatile memory 704, to compare the data with that of the AD converter circuit. When the voltage output from the AD converter circuit 706 is lower, the CPU commands a pulse generation circuit 707 to increase the duty, and when the voltage output from the AD converter circuit 706 is higher, the CPU commands the pulse generation circuit 707 to decrease the duty.

Figure 8:
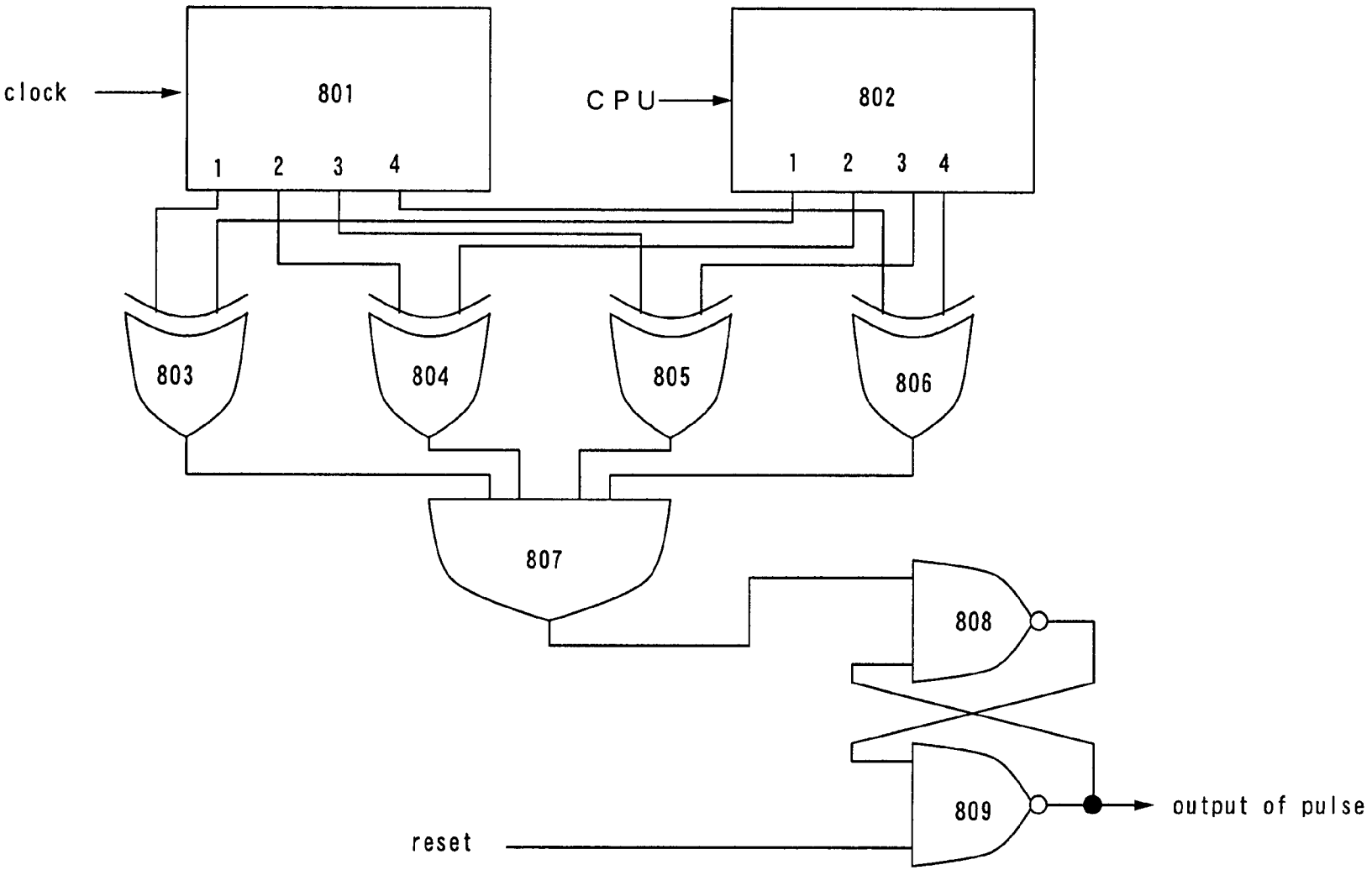
FIG. 8 is a diagram of the pulse generation circuit of the invention.

FIG. 8 shows an internal structure of the pulse generation circuit 707, which is composed of a counter circuit 801, a latch circuit 802, EXOR circuits 803 to 806, an AND circuit 807, and NAND circuits 808 and 809. From the CPU, data having a certain duty is sent to the latch circuit 802 to be latched. A 4-bit CPU is taken for example in this embodiment, but the invention is not limited to it. Meanwhile, a clock signal is input to the counter circuit 801 to be counted. As a counter circuit and a latch circuit, the known circuits can be utilized without limitation.

Figure 11:
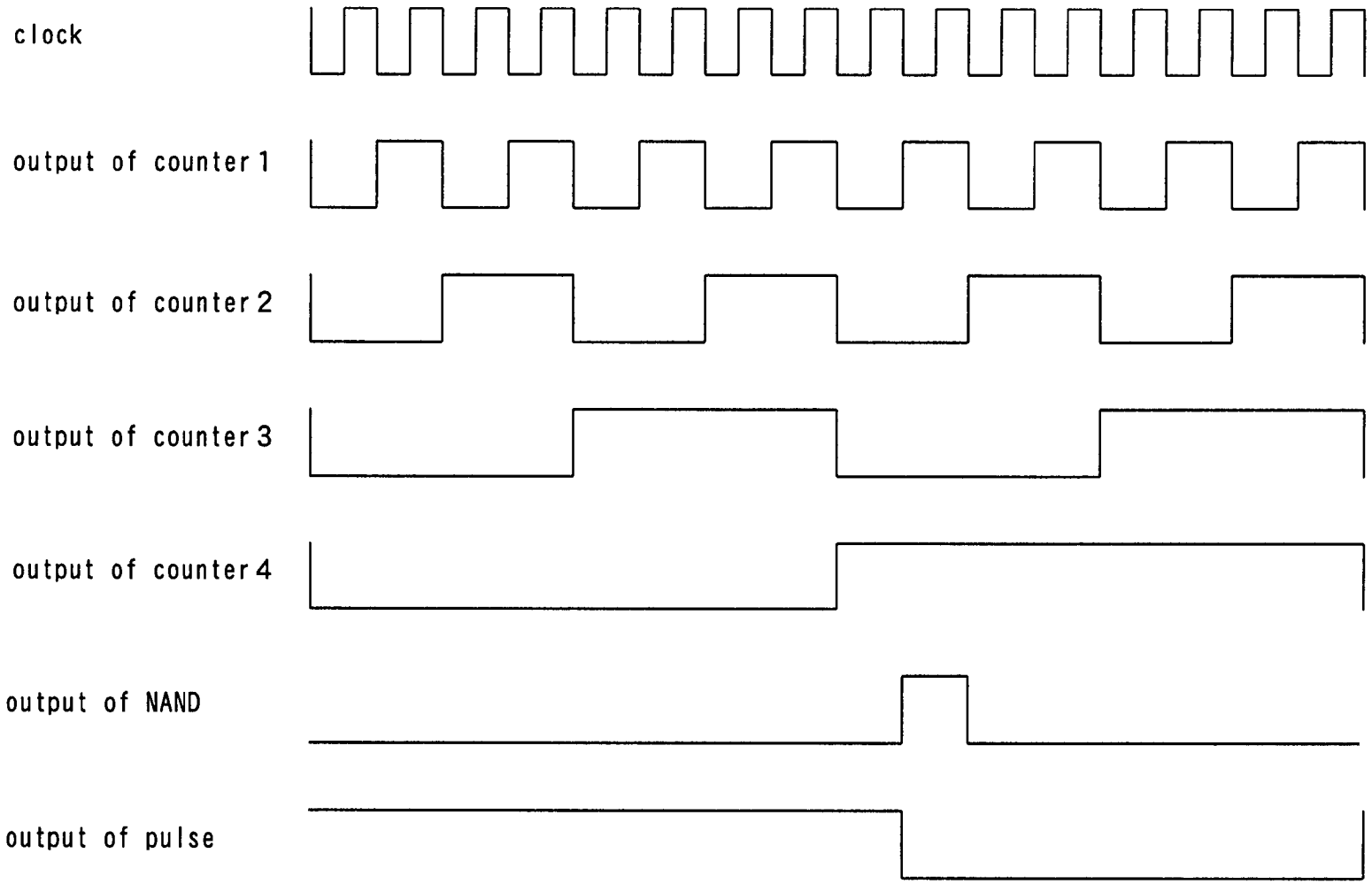
FIG. 11 is a timing chart of the pulse generation circuit of the invention.

FIG. 11 shows the relationship between outputs from the counter and the clock. When corresponding to the data for all bits latched in the latch circuit, outputs from the EXOR circuits become all high as well as outputs from the AND circuit. Then, the pulse output from the latch circuit composed of the NAND circuits 808 and 809 is changed from high to low (it is reset to be high as outputs from the counter circuit come full circle). In FIG. 11, the change is caused when the output signal from the latch circuit is 1 0 0 1. When the data from the CPU is 0 0 0 1, the duty ratio is 1/16 because the output from the pulse generation circuit is high only in the first time of the cycle. When the data from the CPU is 1110, the duty ratio is 14/16.

In this manner, duty ratio can be changed by the change of data sent from the CPU. That is, when a voltage output from the switching regulator is smaller than the expected value, the CPU can count up the data sent to the pulse generation circuit so as to increase the duty and the voltage. Conversely, when a voltage output from the switching regulator is higher than the expected value, the CPU can count down the data sent to the pulse generation circuit so as to decrease the duty and the voltage.

The digital switching regulator control circuit performs as shown in FIG. 7 and FIG. 8. The invention is not limited to this circuit structure described above.

Embodiment 5

Figure 9:
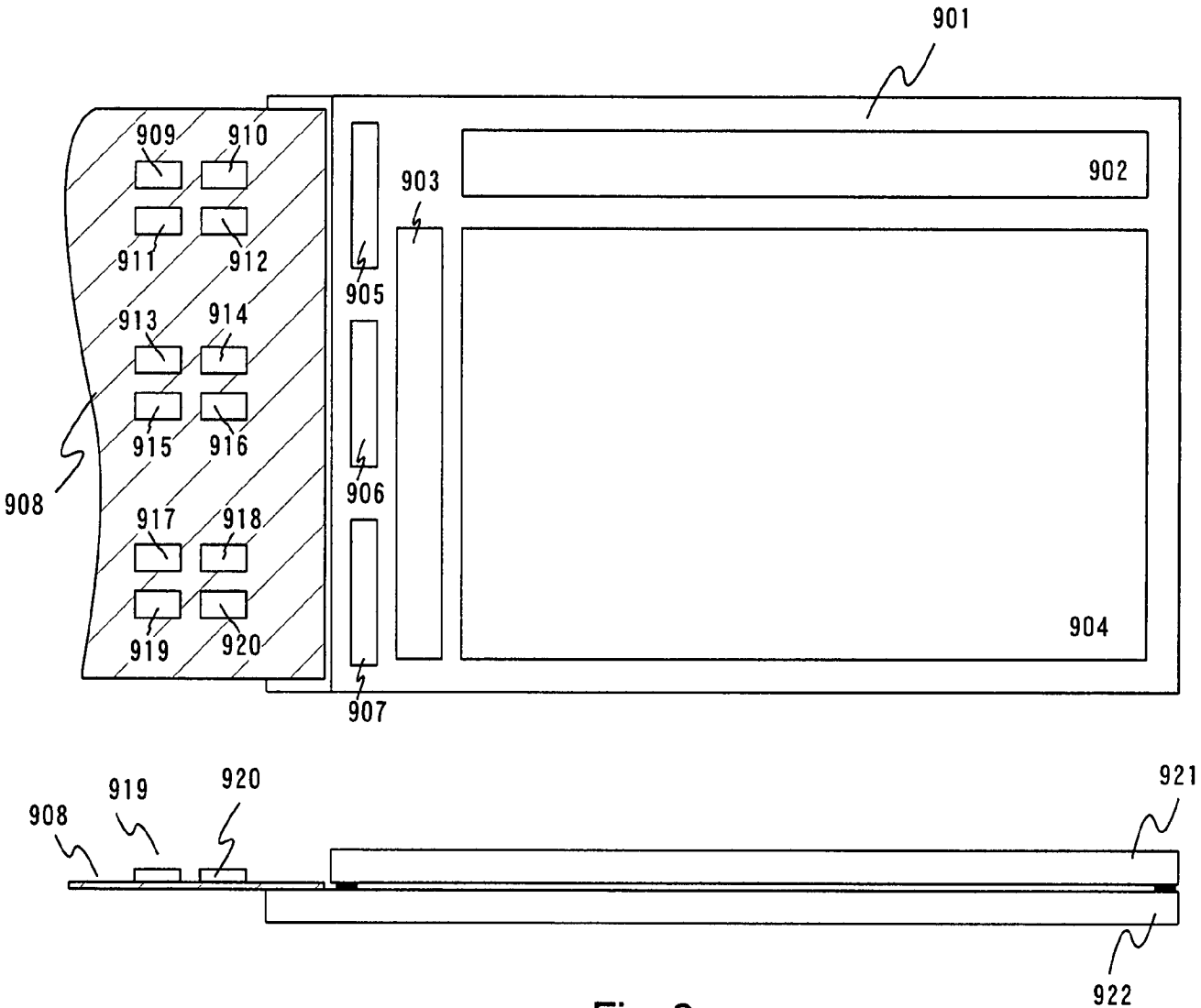
FIG. 9 is a diagram of an embodiment in which the invention is applied to an EL display device.

In a display device, a plurality of switching regulator control circuits of the present invention can be used. FIG. 9 shows an example of the display device with three control circuits of the invention. The voltage of each switching regulator can be set different by changing the external circuit constant. In EL display devices, for example, since the voltage necessary for driving each EL element corresponding to RGB is different, a specific power supply has to be provided to each element.

With reference to FIG. 9, on a substrate 922 integrally formed are a pixel portion 904, a source signal line drive circuit 902, a gate signal line drive circuit 903, and switching regulator control circuits 905, 906 and 907. On an FPC 908, placed are inductors 909, 913 and 917, switching elements 910, 914 and 918, diodes 911, 915 and 919, and smoothing capacitors 912, 916 and 920. However, the inductors, the switching elements, the diodes, and the smoothing capacitors need not be formed on the FPC but can be formed on the substrate. It is possible to form the switching elements by the use of TFTs. Furthermore, the display device can comprise a plurality of signal line drive circuits or other circuits, and supply a different voltage to each circuit from the switching regulators.

Embodiment 6

Figure 10:
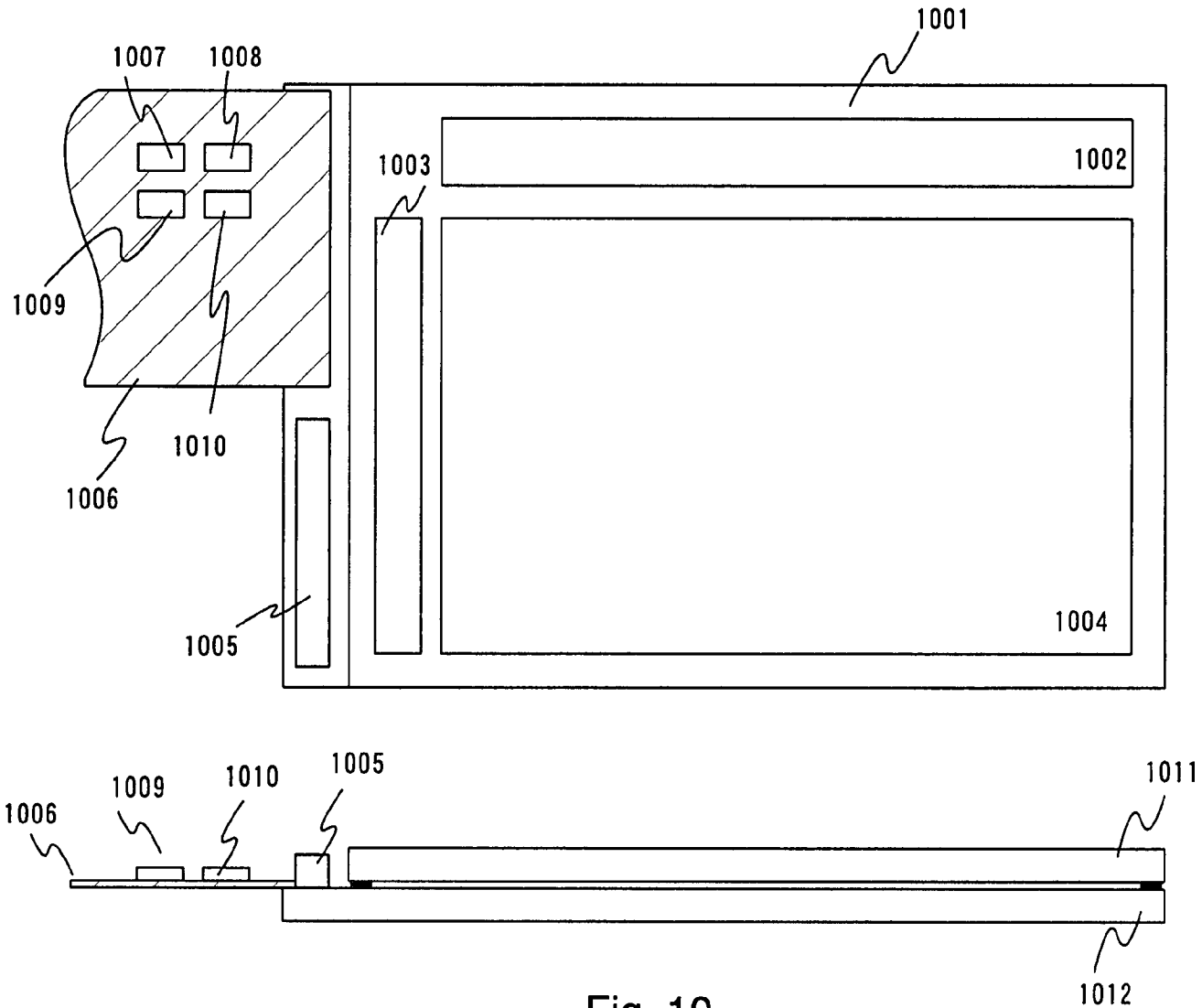
FIG. 10 is an outline drawing of the display device of the invention.

FIG. 10 shows a display device in which a switching regulator control circuit is formed on a substrate, which is different from a substrate of display portion and is attached to the substrate. These two substrates are made of the same material. The structure of this embodiment has two advantages described below. Firstly, as the same material is utilized for the substrates, there is no difference in the coefficient of thermal expansion. Therefore, cracks are not generated and the degradation of reliability is prevented. Secondly, the substrate of display portion is formed by the use of exposure equipment having strict design rules and the substrate of switching regulator control circuit is formed by the use of exposure equipment having loose design rules. Accordingly, reduction in size of the substrate of switching regulator control circuit is achieved.

With reference to FIG. 10, on a substrate 1012 integrally formed are a pixel portion 1004, a source signal line drive circuit 1002, and a gate signal line drive circuit 1003. A switching regulator control circuit 1005 is formed on a substrate made of the same material as the substrate 1012 and attached to the substrate 1012. An inductor 1007, a switching element 1008, a diode 1009, and a smoothing capacitor 1010 are placed on an FPC 1006. However, the inductor, the switching element, the diode, and the smoothing capacitor need not be formed on the FPC but can be formed on the substrate. It is possible to make the switching element by the use of TFTs.

This embodiment can be implemented in combination with the embodiment described above.

Embodiment 7

A display device formed in the above described manner can be used in display portions of various electronic equipment. Explanation will be made on examples of electronic equipment using the display device of the present invention as a display medium.

The examples of such electronic equipment include video cameras, digital cameras, head mounted displays (goggle type displays), game machines, navigation systems, personal computers, PDA (mobile computers, mobile telephones, and electronic books, etc.) or the like. Specific examples of these electronic equipment are shown in FIG. 12.

Figure 12A:
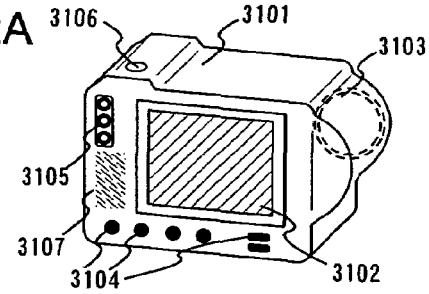
FIGS. 12A to 12G show electronic equipment using the display device of the invention.

FIG. 12A is a digital camera, which is composed of a main body 3101, a display portion 3102, an image-receiving portion 3103, operation keys 3104, an external connection port 3105, a shutter 3106, or the like. The display device of the present invention can be used in the display portion 3102.

Figure 12B:
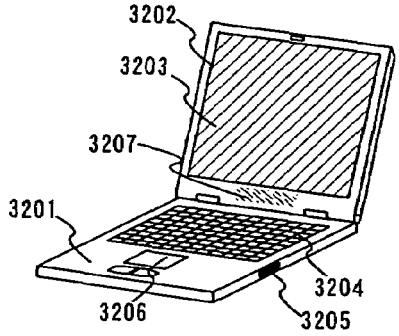

FIG. 12B is a notebook type personal computer, which is composed of a main body 3201, a frame 3202, a display portion 3203, a keyboard 3204, an external connection port 3205, a pointing mouse 3206, or the like. The display device of the present invention can be used in the display portion 3203.

Figure 12C:
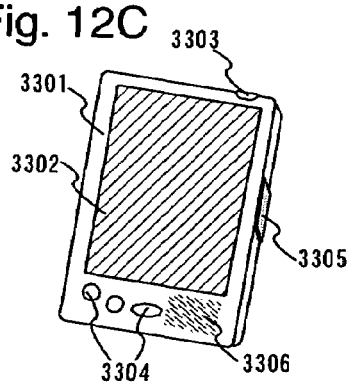

FIG. 12C is a PDA, which is composed of a main body 3301, a display portion 3302, a switch 3303, operation keys 3304, an infrared port 3305, or the like. The display device of the present invention can be used in the display portion 3302.

Figure 12D:
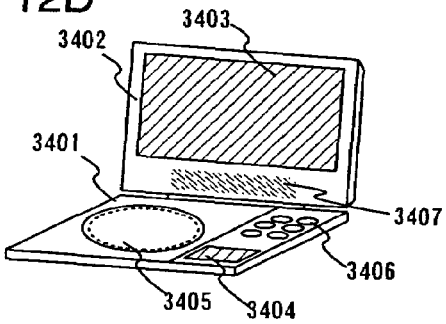

FIG. 12D is an image reproduction device provided with a recording medium (specifically, a DVD playback device), which is composed of a main body 3401, a frame 3402, a recording medium (such as CD, LD, or DVD) read-in portion 3405, operation keys 3406, a display portion A 3403, a display portion B 3404, or the like. The display portion A mainly displays image information, and the display portion B mainly displays character information, and the display device of the present invention can be used in the display portions A and B. Note that image reproduction devices provided with a recording medium include CD reproducing devices and game machines or the like.

Figure 12E:
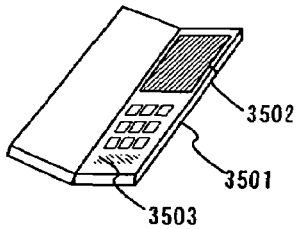

FIG. 12E is a folding portable display device, which is composed of a main body 3501 and a display potion 3502. The display portion 3502 using the display device of the present invention can be formed on the main body 3501.

Figure 12F:
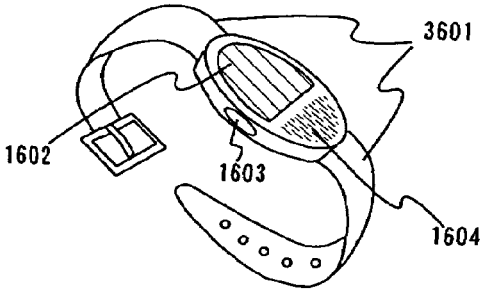

FIG. 12F is a watch type display device, which is composed of a display portion 1602, bands 3601, an operation switch 1603, an audio output portion 1604, or the like.

The display device of the present invention can be used in the display portion 1602.

Figure 12G:
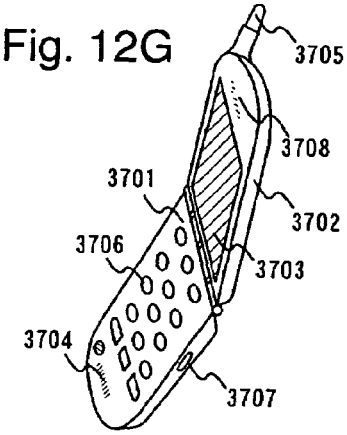

FIG. 12G is a mobile telephone, which is composed of a main body 3701, a frame 3702, a display portion 3703, an audio input portion 3704, an antenna 3705, operation keys 3706, an external connection port 3707. The display device of the present invention can be used in the display portion 3703.

As described above, the application range of the present invention is so wide that the invention can be applied to electronic equipment in various fields. The electronic equipment in this embodiment can be provided in a structure of any combination of Embodiments 1 to 6.

In the conventional portable information equipment, miniaturization of the switching regulator control circuit was difficult, and therefore, reduction in size and weight of portable information equipment was not achieved.

In the present invention, a switching regulator control circuit is integrally formed on a TFT substrate by the use of TFTs to realize miniaturization of the display device. The invention enables to make smaller and lighter weight portable information equipment.

What is claimed is:

1. A display device comprising:

a pixel portion comprising a first thin film transistor; and a switching regulator comprising:

a switching regulator control circuit comprising a second thin film transistor;

a switching element driven according to an output signal from said switching regulator control circuit to raise or lower a voltage; and a capacitor electrically connected to the switching element, wherein the switching regulator control circuit is electrically connected to the capacitor wherein the first thin film transistor and the second thin film transistor are formed over a first substrate, and wherein the switching element is packed over a second substrate.

2. A display device according to claim 1, wherein a plurality of switching regulator control circuits are formed over the substrate.

3. A display device according to claim 1, wherein said display device is a liquid crystal display device.

4. A display device according to claim 1, wherein said display device is an EL display device.

5. A display device according to claim 1, wherein the display device is applied to electronic equipment selected from the group consisting of a digital camera, a notebook type personal computer, a PDA, a DVD player, a folding portable display device, a watch type display device and a mobile telephone.

6. A display device according to claim 1, wherein an FPC is used as the second substrate.

7. A display device comprising:

a pixel portion comprising a first thin film transistor; and a switching regulator comprising:

a switching regulator control circuit comprising a second thin film transistor;

a switching element driven according to an output signal from said switching regulator control circuit to raise or lower a voltage; and a capacitor electrically connected to the switching element, wherein the switching regulator control circuit is electrically connected to the capacitor, wherein the first thin film transistor and the second thin film transistor are formed over a first substrate, and wherein the switching element and the capacitor are packed over a second substrate.

8. A display device according to claim 7, wherein a plurality of switching regulator control circuits are formed over the substrate.

9. A display device according to claim 7, wherein said display device is a liquid crystal display device.

10. A display device according to claim 7, wherein said display device is an EL display device.

11. A display device according to claim 7, wherein the display device is applied to electronic equipment selected from the group consisting of a digital camera, a notebook type personal computer, a PDA, a DVD player, a folding portable display device, a watch type display device and a mobile telephone.

12. A display device according to claim 7, wherein an FPC is used as the second substrate.

13. A display device comprising:

a pixel portion comprising a first thin film transistor; and a switching regulator comprising:

a switching regulator control circuit comprising a second thin film transistor;

a switching element;

an inductor;

a diode; and a smoothing capacitor electrically connected to the switching element, wherein said switching regulator control circuit comprises:

a voltage feed back circuit electrically connected to the smoothing capacitor; and a duty control circuit which controls a switching duty of said switching element, wherein the first thin film transistor and the second thin film transistor are formed over a first substrate, and wherein the switching element is packed over a second substrate.

14. A display device according to claim 13, wherein said inductor, said diode, and said smoothing capacitor are packed over said second substrate.

15. A display device according to claim 13, wherein said switching element is made up of a thin film transistor.

16. A display device according to claim 13, wherein a plurality of switching regulator control circuits are formed over the substrate.

17. A display device according to claim 13, wherein said display device is a liquid crystal display device.

18. A display device according to claim 13, wherein said display device is an EL display device.

19. A display device according to claim 13, wherein the display device is applied to electronic equipment selected from the group consisting of a digital camera, a notebook type personal computer, a PDA, a DVD player, a folding portable display device, a watch type display device and a mobile telephone.

20. A display device according to claim 13, wherein an FPC is used as the second substrate.

21. A display device comprising:

a pixel portion comprising a first thin film transistor over a substrate; and a switching regulator comprising:

a switching regulator control circuit comprising a second thin film transistor formed over the substrate;

a switching element driven according to an output signal from said switching regulator control circuit to raise or lower a voltage; and a capacitor electrically connected to the switching element, wherein the switching regulator control circuit is electrically connected to the capacitor, wherein the first thin film transistor and the second thin film transistor are formed over a first substrate, wherein the switching element is packed over a second substrate, and wherein said switching regulator control circuit uses an analog signal.

22. A display device according to claim 21, wherein said switching regulator control circuit comprises a reference voltage source, an error amplifier circuit, a triangle wave generation circuit, and a PWM comparator.

23. A display device according to claim 21, wherein a plurality of switching regulator control circuits are formed over the substrate.

24. A display device according to claim 21, wherein said display device is a liquid crystal display device.

25. A display device according to claim 21, wherein said display device is an EL display device.

26. A display device according to claim 21, wherein the display device is applied to electronic equipment selected from the group consisting of a digital camera, a notebook type personal computer, a PDA, a DVD player, a folding portable display device, a watch type display device and a mobile telephone.

27. A display device according to claim 21, wherein an FPC is used as the second substrate.

28. A display device comprising:

a pixel portion comprising a first thin film transistor over a substrate; and a switching regulator comprising:

a switching regulator control circuit comprising a second thin film transistor formed over the substrate;

a switching element driven according to an output signal from said switching regulator control circuit to raise or lower a voltage; and a capacitor electrically connected to the switching element, wherein the switching regulator control circuit is electrically connected to the capacitor, wherein the first thin film transistor and the second thin film transistor are formed over a first substrate, wherein the switching element is packed over a second substrate, and wherein said switching regulator control circuit uses a digital signal.

29. A display device according to claim 28, wherein said switching regulator control circuit comprises an AD converter circuit, a nonvolatile memory, a CPU, and a pulse generation circuit.

30. A display device according to claim 28, wherein a plurality of switching regulator control circuits are formed over the substrate.

31. A display device according to claim 28, wherein said display device is a liquid crystal display device.

32. A display device according to claim 28, wherein said display device is an EL display device.

33. A display device according to claim 28, wherein the display device is applied to electronic equipment selected from the group consisting of a digital camera, a notebook type personal computer, a PDA, a DVD player, a folding portable display device, a watch type display device and a mobile telephone.

34. A display device according to claim 28, wherein an FPC is used as the second substrate.

* * * * *